United States Patent [19]

Tsai et al.

[11] 4,296,809

[45] Oct. 27, 1981

[54] IN SITU GASIFICATION OF BITUMINOUS COAL

[75] Inventors: Shirley C. Tsai, Pittsburgh; Richard H. Graham, O'Hara Township, Allegheny County; Robin R. Oder, Export, all of Pa.

[73] Assignee: Gulf Research & Development Company, Pittsburgh, Pa.

[21] Appl. No.: 170,796

[22] Filed: Jul. 21, 1980

[51] Int. Cl.[3] ..... E21B 43/247; E21C 43/00

[52] U.S. Cl. ..... 166/259; 48/210; 48/DIG. 6

[58] Field of Search ..... 166/259, 256, 251, 257, 166/272, 271; 48/210, DIG. 6

[56] References Cited

U.S. PATENT DOCUMENTS

| | | | |
|---|---|---|---|
| 2,788,956 | 4/1957 | Pevere et al. | 166/259 |
| 3,004,594 | 10/1961 | Crawford | 166/259 |
| 3,019,837 | 2/1962 | Mark et al. | 166/256 |
| 3,032,102 | 5/1962 | Parker | 166/256 X |
| 3,209,825 | 10/1965 | Alexander et al. | 166/256 X |
| 3,630,278 | 12/1971 | Parker | 166/259 |
| 3,775,073 | 11/1973 | Rhoades | 166/259 X |
| 4,130,164 | 12/1978 | Datta | 166/259 |

*Primary Examiner*—Stephen J. Novosad

*Attorney, Agent, or Firm*—Deane E. Keith; Forrest D. Stine; Donald L. Rose

[57] ABSTRACT

In the underground gasification of a swelling coal the bulk permeability of the coal proximate to the linkage between the injection and the production holes is increased and the plugging of the linkage during the in situ combustion and gasification procedure is suppressed by subjecting this coal proximate to the linkage between the injection and production holes to a stream of air heated to a temperature below the softening point of the coal prior to the in situ combustion and gasification procedure.

11 Claims, No Drawings

IN SITU GASIFICATION OF BITUMINOUS COAL

SUMMARY OF THE INVENTION

This invention relates to the in situ combustion and gasification of a swelling bituminous coal by the injection of air for combustion into the coal bed from one or more injection holes and the production of a combustible gas from one or more production holes. More particularly, this invention relates to a process for pretreating and conditioning the coal proximate to the high gas-flow linkage in the coal between the injection and production holes prior to the combustion and gasification procedure to make the coal proximate to the linkage more permeable to oxygen in the subsequent combustion and gasification procedure and to reduce the swelling of the coal proximate to the linkage and thereby suppress plugging of the linkage during the combustion and gasification procedure.

DESCRIPTION OF THE INVENTION

Coal is the predominant fossil fuel on the earth as measured by total heat content yet there is much coal that cannot be mined by conventional methods because of various physical, economical and/or safety factors. There has been limited success in recovering the heating value of some unmineable coals by the underground partial combustion and gasification of the coal and the delivery of the resulting combustible gas to the surface for use. However, it has been concluded by workers in the field that underground gasification must be restricted to non-swelling coals because the expansion of a swelling coal induced by the heat from the underground combustion will plug the channels or linkage between the wells through which the combustion gases are flowing and stop the combustion. As a result, there is at present a substantial amount of non-recoverable energy represented by this non-mineable, non-gasifiable, swelling coal.

The in situ gasification of coal by the partial underground combustion of the coal requires at least one hole or well drilled from the surface to the coal deposit for the injection of the oxidizing gas and at least one appropriately spaced production hole or well for the delivery to the surface of the combustible product gas. And most importantly, the gasification process requires a low resistance, high porosity route in the coal bed between the injection hole and the production hole so that large volumes of the oxidizing gas, generally air but also including oxygen-enriched air, can be introduced into the coal deposit at low pressure to support substantial combustion and concurrently deliver large volumes of the desired combustible gas product to the production hole. The low resistance route in the coal bed between the wells is often called the channel or the link or linkage by the workers involved in underground coal gasification.

This link or channel between wells can be naturally occurring permeability in the coal seam involving cracks, fissures and the like. But since naturally occurring paths of suitable gas flow capacity are rare, it is generally necessary to significantly enhance a naturally occurring path for increased gas flow at low pressure or produce an artificial path for high volume gas flow at low pressure by some suitable means. One solution involves the fracturing of the coal bed by injecting under substantial pressure an aqueous mixture with suitable entrained particles as propping agents to open up fracture planes and channels in which the particles settle out to prop the fractures open when the pressure is released. Another method involves the directional drilling of one or more holes through the coal bed, generally along the bottom portion of the bed, between the injection and production holes. Several advantages result from the use of drilled holes. Of particular advantage is the fact that drilled holes result in the production of links with a uniform cross-section and with a known predetermined flow capacity. Since the diameter and/or number of drilled holes is within the control of the operator, very high gas volumes are possible by this linking technique. Other linking methods or combinations of linking methods can be used to obtain the linkage between the wells, which is necessary before the hot air pretreatment and conditioning procedure of the present invention can be utilized.

As stated, there must be at least one injection well and at least one delivery well for the in situ gasification of coal deposits. More generally a suitable pattern of injection wells and gas delivery wells will be prepared in the coal deposit. The well pattern is predetermined according to spacing, orientation and linking for an orderly, progressive burn of the coal deposit for maximum economy in recovery of the coal's heating values. Nevertheless, for simplicity, the discussion herein will, in general, restrict itself to two wells, an injection hole and a production hole, with the understanding that the principles are applicable to a multiple of interrelated injection and production wells.

Heretofore, when the link has been prepared in a non-swelling coal such as a sub-bituminous coal, the oxidizing gas is injected into the injection hole at an appropriate rate and the fire is started in the coal bed at the injection well. This causes a series of reactions and processes to occur simultaneously including volatilization, pyrolysis, oxidation, reduction, and the like, with the result that a combustible product gas is delivered at the production well. However, when a swelling coal, such as a medium-volatile bituminous coal, is ignited, the coal in the link proximate to the flame heats up above its softening temperature and expands until the linkage is eventually plugged whereupon the gas flow stops and the fire extinguishes.

By our invention we have surprisingly discovered that the high-flow linkage between the wells in a swelling coal can be pretreated and conditioned prior to the in situ gasification procedure so that the coal proximate to the linkage will not swell and plug the linkage when the in situ combustion is subsequently initiated. An additional and surprising benefit resulting from this pretreatment and conditioning procedure is that this conditioned coal proximate to the linkage is made substantially more gas permeable thereby greatly enhancing its accessibility to oxygen and as a result greatly assisting the subsequent step of partial combustion and gasification of the coal.

According to our invention this pretreatment and conditioning of the swelling coal before the in situ combustion and gasification procedure is initiated, involves the injection of heated air into the injection hole, through the linkage to the production hole without combustion of the coal. The temperature of this heated air should be at least about 100° C. and preferably at least about 150° C. in order to provide an effective pretreatment and conditioning as evidenced by an increased permeability and porosity and a reduced swellability of the coal proximate to the linkage. Since the injection of the heated air should itself not cause the coal to swell, the maximum temperature of the injected air can be up to but not the same as the temperature at which the coal begins to soften, i.e., the softening temperature of the coal. This softening temperature is a property specific to each particular coal (for the determination of the softening temperature of a coal see pages 152–155 of Chemistry of Coal Utilization, Supplementary Volume, 1963, edited by H. H. Lowry). In general, we prefer that the temperature of the heated air be a maximum of about 350° C. and most prefer that the maximum temperature be about 300° C. The range of about 150° C. to about 250° C. is a particularly suitable range.

The extent to which the swelling coal proximate to the linkage is pretreated and conditioned by the hot air procedure described herein, depends primarily on the temperature of the heated air, the duration of this hot air treatment and the flow rate of the hot air. An increase in any one of these variables will increase the rate of the treatment and decrease the time needed for the desired result. Oxygen-enriched air can be used in special circumstances if the extra cost warrants its use.

The swelling or expansion of certain coals at an elevated temperature is a well known and well studied characteristic. This swelling property also referred to as dilation, is related, although not precisely to the volatility of the coal. Swelling as measured on a dilatometer is generally observed in bituminous coals when the content of volatile matter is between about 15 and about 40 percent with maximum swelling occurring in the range of about 25 to about 30 percent volatile matter. This range broadly encompasses the low-volatile bituminous coals, the medium-volatile bituminous coals and a portion of the high-volatile bituminous coals. However, the suitability of the present procedure for any particular coal to be gasified is more accurately determined from a knowledge of the actual swelling characteristics of the coal, rather than from the volatile matter content of the coal, since the swelling property is the precise characteristic which leads to the plugging problems.

Upon heating a swellable bituminous coal without combustion, it will soften, as stated, at a rather well defined temperature, designated its softening temperature behaving like a plastic material within a plastic temperature range. Pyrolysis of the softened coal and the formation of bubbles within the plastic mass causes a swelling of the coal. Continued pyrolysis for a period of time causes a resolidification of the coal at a greater volume than the original coal. This softening, expansion and resolidification, as briefly mentioned herein, is the process by which the air channels or links in swellable coal are blocked at the high temperatures involved during in situ gasification.

In our process, the coal proximate to the channels or links, that is, the coal forming the surface of the channels and broadly extending from the surface up to about 0.1 (2.5 mm) to about 20 inches (50.8 cm) in thickness, more generally from about one (2.54 cm) to about six inches (15.4 cm) in thickness from the channel walls is pretreated and preconditioned by our hot air process to obtain the desired decrease in swellability and the desired increase in permeability. This conditioning produces two distinct and desirable results. These are an enhanced gas permeability of the coal proximate to the channels and a reduction, preferably an elimination, of the swelling properties of the coal proximate to the channels. The enhanced gas permeability greatly increases the access of oxygen to the coal in the subsequent in situ gasification procedure, thereby assisting in its combustion and gasification. And by reducing the swelling properties of the coal and eliminating plugging of the linkage, the gasification procedure can be carried out without interruption.

The hot air treatment of the subterranean coal as described herein causes a number of physical and chemical events to take place. Initially, there is a vaporization of moisture from the coal and a loss of some volatile carbonaceous material. Some of this may be the result of a minor pyrolysis of the coal. It is believed that the more significant effects are chemical, primarily involving an oxidation of the coal. This is oxidation not involving combustion or fire. The principal oxidation appears to involve the incorporation of oxygen into the molecular structure of the coal. This chemical modification of the coal molecules resulting in a modification in their physical properties may be the principal reason for the reduction in the swelling of the coal. This incorporation of oxygen into the coal structure is demonstrated from an elemental analysis of the hot air treated coal. Another significant chemical reaction is the oxidation without combustion of some chemical species in the coal forming carbon monoxide and carbon dioxide. This type of oxidation is verified by an analysis of the off-gas from the hot gas conditioning procedure. The present process therefore, in part, involves a hot air oxidation of the coal proximate to the underground air channels or links. These chemical and physical changes in the fully pretreated, preconditioned coal proximate to the linkage results in a significant lowering of the heat of combustion of this coal, which is inconsequential considering the total amount of coal that is eventually subjected to in situ gasification.

If the hot air oxidation procedure is incomplete as the result of too low a treating temperature, too short a time of treatment, too low an air flow rate or any combination of these, the coal may still be sufficiently swellable as to cause plugging during combustive gasification and/or may not be sufficiently permeable to significantly enhance access of oxygen to the coal to advance its combustion during gasification. On the other hand, continued hot air treatment after satisfactory gas permeability and reduction in swelling of the coal proximate to the linkage has been accomplished, primarily involves an additional expense without a compensating benefit. Properly treated coal proximate to the channels or links will not swell and plug the channels and will possess a greatly improved permeability as evidenced by visible small fractures without substantial pulverization of the coal. The reduction of the free swelling index of the coal proximate to the linkage to a value of about 1.0 is optimum, however, we consider a reduction in the free swelling index to a value no higher than about 3.0 to be desirable and a free swelling index no higher than about 2.0 to be more desirable. It should be appreciated that the coal, following the pretreatment and conditioning procedure, will exhibit a zone of increasing free swelling index and a decreasing permeability in a direction away from the linkage until the non-affected coal is reached.

It is desirable that the channels or links between the injection and production holes have a substantial capacity for the flow of the hot treating gas such as a flow rate between about 20 (0.57) and about 500 $ft^3$/min (14.2 $m^2$/min) in order that air injection can be undertaken without requiring substantial pressure for the injection. Therefore, the injection pressure can be as low as about atmospheric pressure and more generally at least about 25 psi (172.4 kPa). On the other hand, the maximum pressure can be as high as about 2,000 psi (13.8 MPa), but more generally it wil be no higher than about 500 psi (3.45 MPa). We have found that a further advantage in using a higher temperature for the pretreatment, such as 250° C. instead of 150° C. is that the coal proximate to the link becomes more gas permeable and more friable, which produces more surface area and aids the subsequent combustion and gasification.

When combustion is initiated in the coal seam at the injection hole to initiate the gasification procedure, a series of oxidation and reduction reactions occur, which are not thoroughly understood. The net result is a combustible product gas comprising carbon monoxide, hydrogen and some methane as its principal combustibles and having a heat content which depends on many factors including whether supplemental oxygen and/or water are added to the oxidizing gas. Once the coal proximate to the channels or links has been adequately conditioned, as described herein, plugging will not occur during the combustion and gasification. As the fire progresses in the coal seam, the coal not proximate to the original channels, which had not been affected by the hot air pretreatment, will successfully burn without plugging the gas channels because the conditions which permitted plugging to occur are no longer present. In an integrated field operation involving in situ gasification in a portion of the coal seam, the sensible heat in the hot combustible product gas produced from the in situ gasification in one portion of the coal seam can be used to heat the air for the hot air pretreatment in another portion of the coal seam.

As used herein, the expression Free-Swelling Index or free-swelling index, also abbreviated as FSI, is made with reference to ASTM D720.

DESCRIPTION OF PREFERRED EMBODIMENTS

Each of the core samples involved in the following experiments was taken with its axis parallel to the bedded plane (i.e., having its axis horizontal to the surface of the earth in an untilted coal bed), except where specifically indicated. Each experiment utilized a two-inch (5.1 cm) diameter core three to four inches (7.6 to 10.2 cm) long. The core was mounted in a 2.25 inch (5.7 cm) inner diameter reactor which was positioned in a constant temperature fluidized-sand bath to maintain the treating temperature. The treating gas was fed through a tube positioned in the fluidized bed to heat the gas to the treating temperature. In all experiments the gas was fed at a rate of 200 cc per minute.

The swelling property of the samples in these experiments was measured by ASTM D720. The dilation of the feed coal and certain treated coals was determined in an Audibert-Arnu dilatometer test. The permeability of the coal, determined as millidarcy (md), was measured with respect to air using a Hassler tube mounted in a micropermeameter, which was obtained from Core Laboratories, Inc., Dallas, Texas.

The coal used in these experiments was a highly-swelling bituminous coal from the Pocahontas seam in a mine near Bluefield, West Virginia. It had a free-swelling index of 8.5, a volatile content of 31 percent, an ash content of 2.12 percent and a heating value of 15,200 Btu/lb (8,460 kcal/kg). Elemental analysis showed 84.73 percent carbon, 4.63 percent hydrogen, 3.1 percent oxygen and 0.59 percent sulfur. Nitrogen was not determined.

EXAMPLES 1-8

A series of core samples from this coal were tested to determine the effect on the coal's properties of hot air treatment at different temperatures and for different periods of time. The effect of hot nitrogen as a treating gas was also evaluated. The data and analyses are set out in Table I.

TABLE I

| | Coal | Ex. 1 | Ex. 2 | Ex. 3 | Ex. 4 | Ex. 5 | Ex. 6 | Ex. 7[a] | Ex. 8 |
|---|---|---|---|---|---|---|---|---|---|
| Treating gas | — | air | air | air | air | air | air | air | $N_2$ |
| Temperature °C. | — | 100 | 100 | 150 | 150 | 200 | 250 | 250 | 250 |
| Days treated | — | 7 | 21 | 4 | 6 | 3 | 4 | 3 | 4 |
| Volatiles,wt % | 31.2 | — | — | — | — | — | 34.9 | — | 35.7 |
| Oxygen content,wt % | 3.1 | 4.5 | 5.3 | 5.2 | 6.4 | 9.7 | 16.2 | 13.3 | 4.3 |
| Permeability,md | 2-11 | — | — | 11 | — | 35 | 107 | 148 | 10 |
| FSI | 8.5 | 9.0 | 4.5 | 4.0 | 2.0 | 3.5 | 1.0 | 3.0 | 9.0 |
| Weight change, % | — | +0.4 | +0.9 | +0.4 | +0.1 | +0.7 | −4.3 | −3.5 | −2.5 |
| Heat of combustion, $10^3$ Btu/lb[b] | 15.2 | 15.5 | 14.8 | — | 14.2 | 12.8 | 11.1 | 12.1 | 15.5 |
| Btu recovered, % | — | 102 | 98 | — | 93 | 90 | 73 | 77 | 99 |

[a]axis of the core is perpendicular to the bedding plane
[b]one Btu/lb = 0.556 kcal/kg The core sample of Example 6, treated for a total of four days, had also been analyzed for permeability after two and three days. The initial permeability of the core was 2.0, after two days it was 27.5, after three days it was 77.2 and after four days it was 107 as reported in Table I.

The treated core samples resulting from Examples 3 and 5 were further analyzed in the Audibert-Arnu dilatometer test. The results are set out in Table II and are compared with an analysis of the untreated coal.

TABLE II

| | Coal | Ex. 3 | Ex. 5 |
|---|---|---|---|
| Treating temperature, °C. | — | 150 | 200 |
| Days treated | — | 4 | 3 |
| Initial softening temperature, °C. | 363 | 420 | 393 |
| Initial dilation temperature, °C. | 405 | — | — |
| Maximum dilation temperature, °C. | 480 | — | — |
| Maximum contraction, % | 32 | 15 | 14 |
| Maximum dilation, % | 199 | 0 | 0 |
| Free-swelling index (FSI) | 8.5 | 4.0 | 1.0 |

EXAMPLE 9

Another core sample was obtained from the same coal. It had an initial permeability of 29.5 due to some natural fracturing. After one day of treatment at 250°

C., the permeability increased to 67 and the free-swelling index decreased from 8.5 to 7.5. No further treatment or analysis of this core was undertaken.

EXAMPLE 10

A further core sample from the coal was treated at 200° C. with heated air at an air flow rate of 200 cc per minute for four days. The resulting coal had a free-swelling index of 2.0. After one day of the treatment, a sample of the exit gas was analyzed. The analysis, normalized after its 0.2 weight percent water content was omitted, was 17.67 percent oxygen, 1.24 percent carbon monoxide, 1.27 percent carbon dioxide, 17.67 percent oxygen, 78.84 percent nitrogen and 0.99 percent argon.

EXAMPLE 11

The application of hot air preconditioning of a subterranean, medium-volatile bituminous coal deposit having a free-swelling index of 8.5 is described. The coal occurs in a generally horizontal seam about ten feet (3.05 meters) thick and about 1,000 feet (305 meters) deep. It is determined that it is suitable for in situ gasification. Two twenty-inch (50.8 cm) diameter bore holes, an injection well and a production well, are drilled about 100 feet (30.5 meters) apart to the bottom of the coal bed. A thirteen and three-eighth inch (34 cm) casing is placed in each hole and then a six-inch (15.2 cm) diameter hole is drilled horizontally by directional drilling along the bottom of the coal seam between the two well holes. After this link is completed, a six-inch (15.2 cm) injection liner is placed in the injection well. Air is heated to a temperature of about 250° C. and is injected into the injection well at the rate of about 80 $ft^3$/min (2.26 $m^3$/min) (standardized to one atmosphere and 15.6° C.). Injection continues at this rate for six days after which time a layer of coal extending about 1.8 inches (4.57 cm) from the bore hole into the coal has a free-swelling index of about 1.0. Air injection is continued for two more days, after which time the layer having a free-swelling index of about 1.0 now extends about 2.5 inches (6.35 cm) from the bored channel between the well bores into the bed of coal. Combustion air is now injected into the injection hole at a rate of 1,500 $ft^3$/min (42.5 $m^3$/min) (standardized to one atmosphere and 15.6° C.) and a fire is ignited in the coal at the bottom of the injection well. After the underground combustion stabilizes, a combustible product gas is obtained at the production well. In situ combustion and gasification continues without plugging until the coal is exhausted in the zone between the wells.

It is to be understood that the above disclosure is by way of specific example and that numerous modifications and variations are available to those of ordinary skill in the art without departing from the true spirit and scope of the invention.

We claim:

1. In the underground gasification of a swellable bituminous coal by the injection of air into the high gas flow linkage between an injection hole and a production hole accompanied by the concurrent underground partial combustion and gasification of said coal, a method for pretreating and conditioning the coal proximate to said linkage before said partial combustion and gasification is initiated which comprises the step of injecting pretreating air at a temperature between about 100° C. and up to about the softening temperature of said coal into said injection hole and through said linkage to said production hole in the absence of combustion at a flow rate and for such time as will substantially reduce the swelling of said coal proximate to said linkage, whereby the gas permeability of said coal proximate to said linkage is enhanced and the plugging of said linkage in the subsequent partial combustion and gasification step is suppressed.

2. In the underground gasification of a swellable bituminous coal in accordance with claim 1 the method wherein said pretreating air is at a temperature between about 100° C. and about 350° C.

3. In the underground gasification of a swellable bituminous coal in accordance with claim 1 wherein the free-swelling index of said coal proximate to said linkage is reduced to a value no greater than about 3.0 by the pretreating step.

4. In the underground gasification of a swellable bituminous coal in accordance with claim 1 wherein said linkage is a hole drilled through the bed of coal between said injection well and said production well.

5. In the underground gasification of a swellable bituminous coal in accordance with claim 1 wherein said linkage is the result of hydraulic fracturing in the bed of said coal between the injection well and the production well.

6. In the underground gasification of a swellable bituminous coal in accordance with claim 1 wherein said pretreating air is at a temperature between about 150° C. and about 300° C.

7. In the underground gasification of a swellable bituminous coal in accordance with claim 1 wherein the initial free-swelling index of said bituminous coal is greater than about 3.0.

8. In the underground gasification of a swellable bituminous coal in accordance with claim 1 wherein the free-swelling index of said coal proximate to said linkage is reduced to a value no greater than about 2.0 by the pretreating step.

9. In the underground gasification of a swellable bituminous coal in accordance with claim 1 wherein the free-swelling index of said coal proximate to said linkage is reduced to a value of about 1.0 by the pretreating step.

10. In the underground gasification of a swellable bituminous coal in accordance with claim 1 wherein said pretreating air is at a temperature between about 150° C. and about 250° C.

11. In the underground gasification of a swellable bituminous coal in accordance with claim 1 wherein said swellable bituminous coal has a volatile content between about 15 and about 40 percent.

* * * * *